US007764158B2

(12) United States Patent
Kubono et al.

(10) Patent No.: US 7,764,158 B2
(45) Date of Patent: Jul. 27, 2010

(54) ELECTROMAGNETIC INDUCTION TYPE PROCESSING APPARATUS

(75) Inventors: Fumio Kubono, Tokyo (JP); Yoshihito Ishibashi, Tokyo (JP); Shoji Nagai, Tokyo (JP); Yuko Yoshida, Tokyo (JP)

(73) Assignee: Sony Corporation, Tokyo (JP)

( * ) Notice: Subject to any disclaimer, the term of this patent is extended or adjusted under 35 U.S.C. 154(b) by 312 days.

(21) Appl. No.: 11/778,753

(22) Filed: Jul. 17, 2007

(65) Prior Publication Data

US 2008/0030292 A1 Feb. 7, 2008

(30) Foreign Application Priority Data

Jul. 21, 2006 (JP) ..... 2006-199389

(51) Int. Cl.
*H01F 27/28* (2006.01)
*H01F 27/36* (2006.01)
*H01F 5/00* (2006.01)

(52) U.S. Cl. ..... 336/232; 336/84 C; 336/200; 336/223

(58) Field of Classification Search ..... None
See application file for complete search history.

(56) References Cited

U.S. PATENT DOCUMENTS 3,898,635 A * 8/1975 Kulterman ..... 340/870.32
5,804,963 A * 9/1998 Meyer ..... 324/207.17
7,202,768 B1 * 4/2007 Harvey et al. ..... 336/232
7,370,403 B1 * 5/2008 Hsu et al. ..... 29/602.1
2004/0046017 A1 * 3/2004 Sueyoshi et al. ..... 235/382
2004/0140003 A1 * 7/2004 Kurokawa et al. ..... 136/252
2005/0182287 A1 * 8/2005 Becker ..... 600/13
2005/0275497 A1 * 12/2005 Ramadan et al. ..... 336/200
2006/0001518 A1 * 1/2006 Hayashi et al. ..... 336/200
2007/0287025 A1 * 12/2007 Furubayashi et al. ..... 428/640
2008/0001699 A1 * 1/2008 Gardner et al. ..... 336/200

FOREIGN PATENT DOCUMENTS

JP 2005-38396 9/2005
JP 2005-234827 9/2005

* cited by examiner

*Primary Examiner*—Elvin G Enad
*Assistant Examiner*—Mangtin Lian
(74) *Attorney, Agent, or Firm*—Finnegan, Henderson, Farabow, Garrett & Dunner, L.L.P.

(57) ABSTRACT

An electromagnetic induction type processing apparatus includes a coil and a functional device. The coil is configured to generate electromotive force from a magnetic field supplied from the outside. The functional device is configured to operate with the electromotive force and containing conductive substance having a conductivity with which eddy current to be generated in the conductive substance by the magnetic field supplied from the outside is suppressed such that the lowest electromotive force for operation of the functional device is assured regardless of a magnetic field generated by the eddy current and acting in the opposite direction to that of the magnetic field supplied from the outside.

5 Claims, 7 Drawing Sheets

ELECTROMAGNETIC INDUCTION TYPE PROCESSING APPARATUS

CROSS REFERENCES TO RELATED APPLICATIONS

The present invention contains subject matter related to Japanese Patent Application JP 2006-199389 filed with the Japan Patent Office on Jul. 21, 2006, the entire contents of which being incorporated herein by reference.

BACKGROUND OF THE INVENTION

1. Field of the Invention

This invention related to an electromagnetic induction type processing apparatus, and more particularly to an electromagnetic induction type processing apparatus which uses electromotive force generated by a magnetic field supplied from the outside as a power supply to operate a functional device disposed in the apparatus and containing conductive substance.

2. Description of the Related Art

An apparatus is in the past available wherein a magnetic field is interlinked with a coil to generate electromotive force in the coil and the generated electromotive force is utilized as power in the apparatus.

An example of an existing processing apparatus of the type described is shown in FIG. 1.

Referring to FIG. 1, the power supplying apparatus 1 is used to supply power to a processing apparatus 2 and includes a power supply 11 and a coil 12 for generating, for example, a sine wave signal. In the power supplying apparatus 1, the power supply 11 generates and supplies a sine wave signal to the coil 12 so that a magnetic field (linkage magnetic field 21 indicated by lines of magnetic force of broken line arrow marks) is radiated from the coil 12 to an external space.

The processing apparatus 2 utilizes power acquired from the power supplying apparatus 1 to perform processes and includes a coil 31, a regulator 32 and a circuit 33. The processing apparatus 2 is, for example, carried by a user and moved toward the power supplying apparatus 1 by the user until it is positioned closely to the power supplying apparatus 1. Thereupon, the circuit field radiated from the power supplying apparatus 1 is interlinked with the coil 31 to generate electromotive force in the coil 31. The electromotive force generated in the coil 31 is converted into a fixed voltage by the regulator 32 and then supplied to the circuit 33. The circuit 33 operates with the electromotive force to implement a predetermined function which the processing apparatus 2 has.

In the apparatus described above, in order to sufficiently assure a linkage circuit field, an obstacle which may disturb the circuit field does not exist around the coils 12 and 31, and the power supply 11 in the power supplying apparatus 1 and the regulator 32 and the circuit 33 in the processing apparatus 2 are formed from electronic circuits which handle an electric signal. Therefore, the power supplying apparatus 1 and the processing apparatus 2 contain some conductive substance. If such conductive substance exists in the region of the linkage magnetic field, then eddy current is generated. The eddy current generates a secondary magnetic field in a direction opposite to that of the linkage magnetic field. As a result, the efficiency in power supply is deteriorated.

Therefore, in the existing apparatus, in order to positively assure the space for the linkage magnetic field for power supply, the conductive substance of the electronic circuits and so forth is disposed in a spaced relationship away from the linkage magnetic field as seen in FIG. 1.

FIG. 2 shows another existing processing apparatus. The processing apparatus is adopted popularly in IC cards and so forth.

Referring to FIG. 2, the processing apparatus (IC card) 40 shown includes a coil 41, a regulator 42 and a circuit 43. The coil 41 is disposed so as to extend along an outer periphery of the processing apparatus 40. Therefore, the regulator 42 and the circuit 43 are disposed within the coil 41. However, if the regulator 42 and the circuit 43 have a comparatively great size with respect to the area of the coil 41, then they make an obstacle to the linkage magnetic field 21 and deteriorates the efficiency in power transmission from the power supplying apparatus 1 to the processing apparatus 40. Therefore, usually the area of the regulator 42 and the circuit 43 is reduced sufficiently with respect to the area of the coil 41 thereby to reduce the influence on the power transmission.

FIG. 3 shows a further existing processing apparatus.

Referring to FIG. 3, the processing apparatus (IC card) 50 shown includes a coil 51, a regulator 52 and a circuit 53. A magnetic member 54 is disposed within the coil 51 of the processing apparatus 50 as seen in FIG. 3. The circuit member 54 may be formed, for example, using ferrite as a main raw material. Since the magnetic substance has a property of collecting magnetic fluxes, where the configuration of the processing apparatus 50 described above is employed, eddy current which may be generated by a conductive substance of the circuit 53, regulator 52 and so forth disposed in contact with the surface of the magnetic member 54 can bed prevented (a processing apparatus of the type described is disclosed, for example, in Japanese Patent Laid-Open No. 2005-234827). It is to be noted, however, that the incorporation of the magnetic substance in this instance makes restrictions to the size and the volume and raises the cost.

SUMMARY OF THE INVENTION

However, it is demanded also for an apparatus which makes use of such power transmission as described above to have various additional functions. Where an IC card is taken as an example, it is demanded to incorporate a functional device such as a display device or a keyboard.

However, where any of such functional devices is disposed on an IC card, the area of the functional device may not be ignored with respect to the area of the coil. Further, since such functional devices frequently contain some conductive material, there is the possibility that disposition of any of such functional devices in a processing apparatus may make a restriction that gives rise to deterioration of the efficiency in power transmission or increase in cost.

Therefore, it is demanded to provide a processing apparatus which can readily suppress deterioration of the efficiency in power transmission even if a functional device is incorporated therein.

According to an embodiment of the present invention, there is provided an electromagnetic induction type processing apparatus including a coil configured to generate electromotive force from a magnetic field supplied from the outside, and a functional device configured to operate with the electromotive force and containing conductive substance having a conductivity with which eddy current to be generated in the conductive substance by the magnetic field supplied from the outside is suppressed such that the lowest electromotive force for operation of the functional device is assured regardless of a magnetic field generated by the eddy current and acting in the opposite direction to that of the magnetic field supplied from the outside.

The functional device may have an electrode electrically connected thereto and having a cut within a range within which a desired function of the function device is assured.

The functional device may be electronic paper, a dye-sensitized solar cell, an operation button or a sensor which contains the conductive substance.

With the electromagnetic induction type processing apparatus, power supplied from the outside can be acquired. Particularly, even if the functional device is disposed within the processing apparatus, a drop of the efficiency in power transmission can be suppressed readily.

The above and other features and advantages of the present invention will become apparent from the following description and the appended claims, taken in conjunction with the accompanying drawings in which like parts or elements denoted by like reference symbols.

DETAILED DESCRIPTION OF THE PREFERRED EMBODIMENTS

Figure 1:
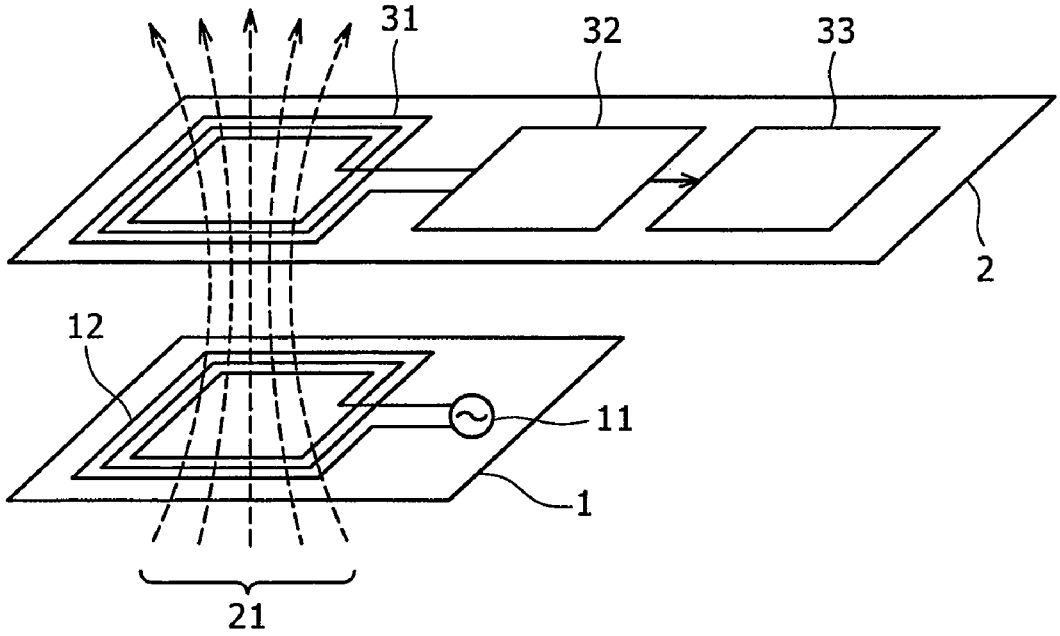
FIG. 1 (Prior Art)
FIGS. 1 to 3 are schematic views showing different examples of an existing processing apparatus.
Figure 2:
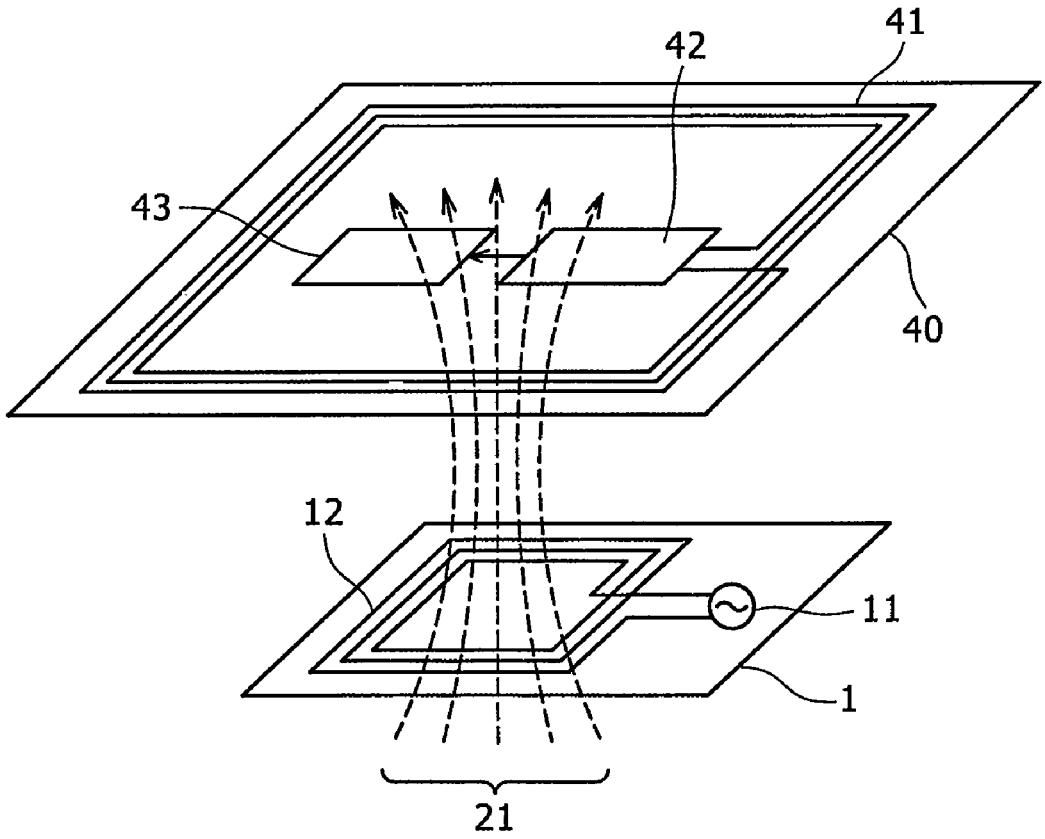
FIG. 2 (Prior Art)
Figure 3:
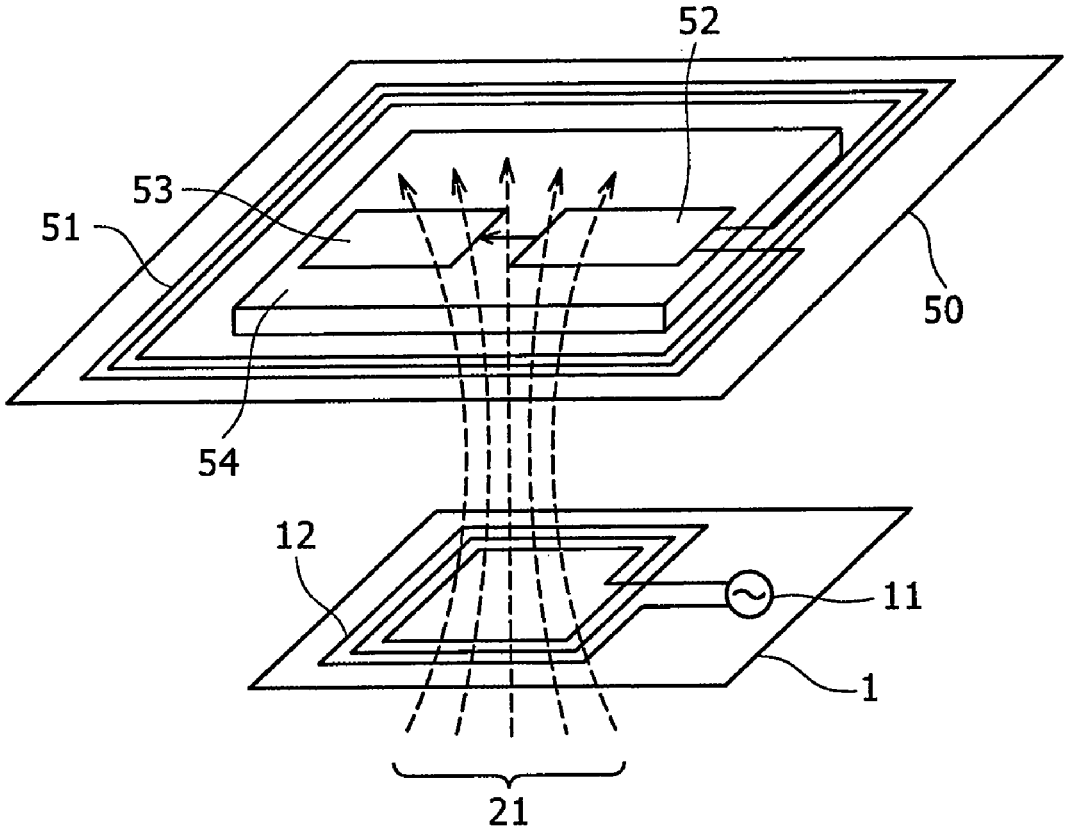
FIG. 3 (Prior Art)
Figure 4:
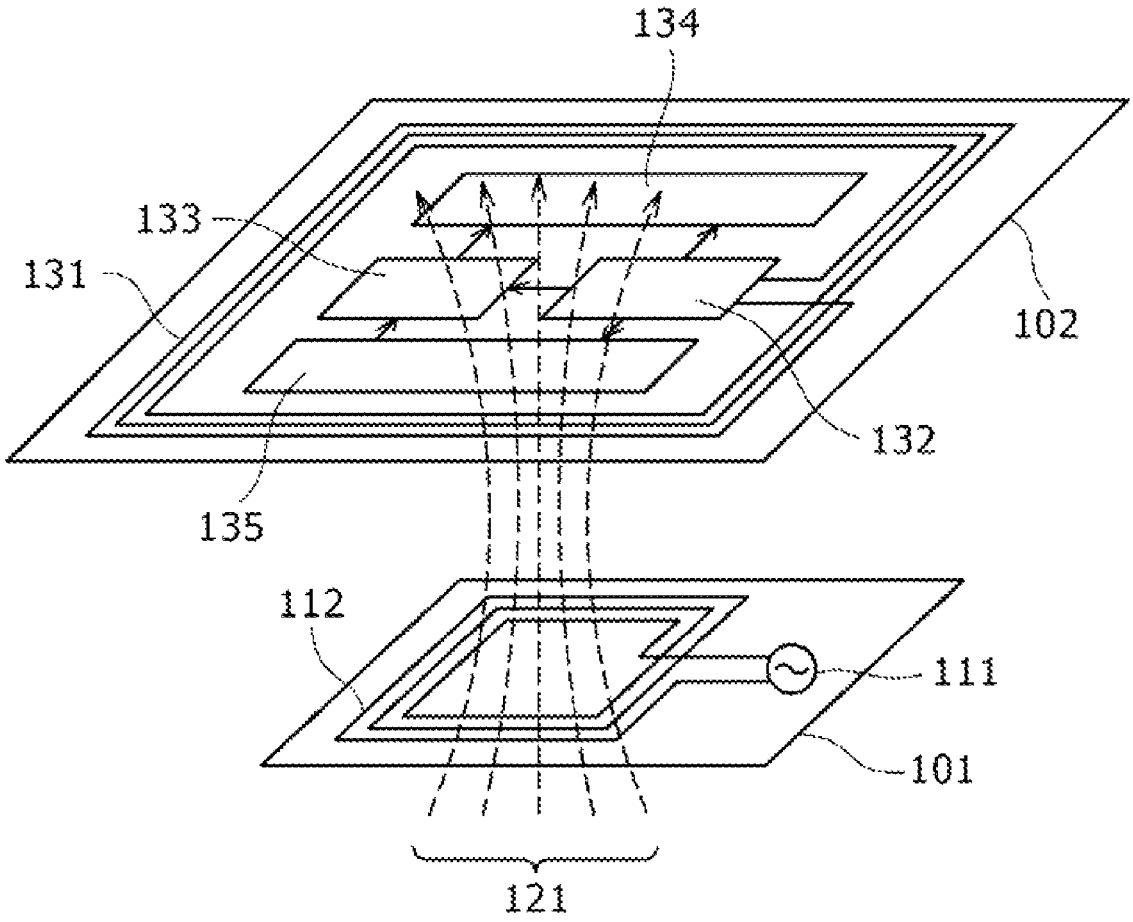
FIG. 4 is a schematic view showing an example of a processing apparatus to which the present embodiment is applied.

FIG. 4 shows a processing apparatus to which the present invention is applied.

Referring to FIG. 4, a power processing apparatus 101 is used to supply power to a processing apparatus 102 positioned in the proximity thereof. The power supplying apparatus 101 includes a power supply 111 and a coil 112 for generating a sine wave signal. A signal (for example, a sine wave signal) generated by the power supply 111 is supplied to the coil 112. Consequently, a magnetic field (linkage magnetic field 121 indicated by lines of magnetic force of broken line arrow marks) is radiated from the coil 112 to an external space.

The processing apparatus 102 includes a coil 131, a regulator 132, a control circuit 133, a display device 134 and a keyboard 135. If the processing apparatus 102 is moved toward the coil 131 to a position close to the coil, for example, by a user such that it is interlinked with the linkage magnetic field 121, then electromotive force is generated by the linkage magnetic field 121. The electromotive force is converted into a fixed voltage by the regulator 132 so that power is supplied to the control circuit 133, display device 134 and keyboard 135. The control circuit 133 operates with the electromotive force after converted into a fixed voltage by the regulator 132 and controls the display substance on the display device 134 in response to a key operation inputted from the keyboard 135. The display device 134 operates with the electromotive force after converted into a fixed voltage by the regulator 132 and displays image information. The keyboard 135 operates with the electromotive force after converted into a fixed voltage by the regulator 132 and accepts an inputting operation by the user and then supplies the accepted input information to the control circuit 133.

It is to be noted that, in the following description, it is assumed that the electrodes of the display device 134 and the keyboard 135 are distributed uniquely in a particular region within the processing apparatus 102. Also it is assumed that any functional device used in the following description is a substance which is magnetically transparent and has little magnetic influence but only has conductivity.

In the existing apparatus, in order to assure a sufficient linkage magnetic field 121 (electromotive force generated by the linkage magnetic field 121), a large obstacle which disturbs the linkage magnetic field 121 is not disposed around the coil 112 and the coil 131. In particular, the regulator 132 and the control circuit 133 in the processing apparatus 102 are formed sufficiently small with respect to the area of the coil 131 such that a sufficient path along which the linkage magnetic field 121 passes is assured so that the processing apparatus 102 may obtain sufficiently high electromotive force from the linkage magnetic field 121. Further, since usually some functional device such as the display device 134 or the keyboard 135 contains conductive substance, there is the possibility that, if such conductive substance exists within the region of the linkage magnetic field 121, then eddy current may be generated there. Accordingly, a secondary magnetic field is generated in the opposite direction to that of the linkage magnetic field 121 by the eddy current. As a result, since the electromotive force induced in the coil 131 is dropped, there is the possibility that the distance range within which the power supplying apparatus 101 and the processing apparatus 102 can cooperate with each other may be reduced.

Figure 5:
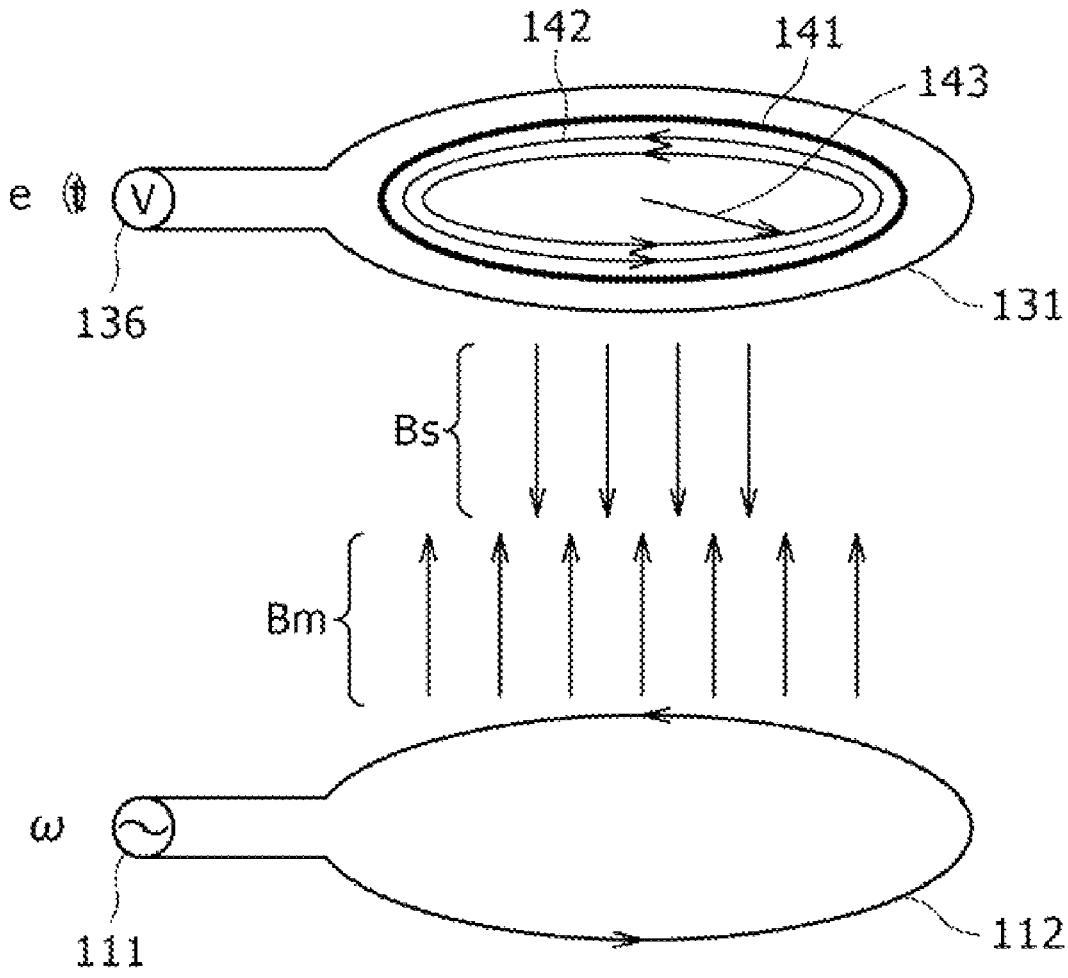
FIG. 5 is a schematic view illustrating an example of a manner in which eddy current is generated.

FIG. 5 illustrates an example of a manner of generation of eddy current by the linkage magnetic field 121 between the power supplying apparatus 101 and the processing apparatus 102 shown in FIG. 5.

In the power supplying apparatus 101, the power supply 111 generates a sine wave signal to generate a magnetic field at an angular velocity ω from the coil 112. If the magnetic field generated by the coil 112 exhibits a uniform flux linkage density Bm at the coil 131 of the processing apparatus 102, then the magnetic fluxes Bm interlink also with conductive substance 141 disposed in the proximity of the coil 131 in the processing electromotive 102. At this time, current flowing concentrically, that is, eddy current, is generated. Where the conductivity of the conductive substance 141 is represented by σ and the distance 143 from the center is represented by r, eddy current (Is) 142 can be determined in accordance with the following expression (1):

$$Is = -\frac{\sigma r \omega B_m}{2} \cos\omega t \tag{1}$$

The eddy current (Is) 142 flows in the opposite direction to that of current flowing in the coil 131, and accordingly, also magnetic fluxes Bs generated from the entire conductive substance 141 by the eddy current (Is) 142 have a direction opposite to that of the magnetic fluxes Bm. The magnetic fluxes Bs increase in proportion to the magnitude of the eddy current (Is) 142 as represented by the following expression (2):

$$Bs \propto Is \tag{2}$$

If it is assumed that the magnetic fluxes Bm and The magnetic fluxes Bs are distributed uniformly and the composite magnetic fluxes are represented by Bg, then the induction electromotive force e(t) can be determined in accordance with the following expression (3):

$$e(t) = -\int \frac{\partial B_g}{\partial t} ds \quad (3)$$

Accordingly, as the conductivity of the conductive substance 141 increases (the electricity is easily conducted), the magnetic fluxes Bs in the opposite direction to that of the magnetic fluxes Bm increase, and as a result, the induction electromotive force e(t) of the processing apparatus 102 decreases. In other words, if the conductivity of the conductive substance 141 is decreased, then the eddy current to be generated in the conductive substance 141 can be reduced.

Figure 6:
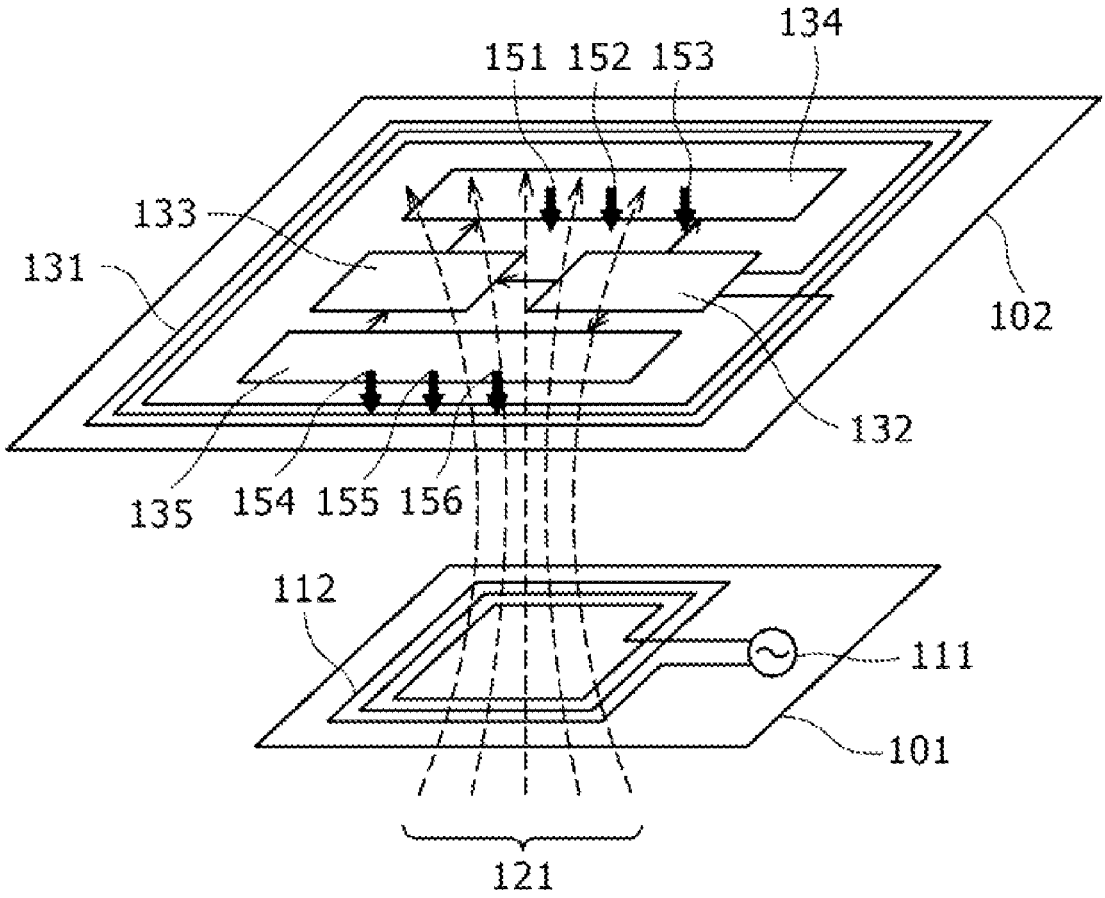
FIG. 6 is a schematic view illustrating an example of magnetic fluxes generated by eddy current.

In the arrangement shown in FIG. 4, the linkage magnetic field 121 directed from the power supplying apparatus 101 side to the processing apparatus 102 side (directed upwardly in FIG. 4) acts to generate eddy current in such functional devices as the display device 134 and the keyboard 135 which are formed from conductive substance as seen in FIG. 6. Consequently, magnetic fluxes in the opposite direction to that of magnetic fluxes of the linkage magnetic field 121 are generated as indicated by arrow marks 151 to 156. In FIG. 6, the arrow marks 151 to 153 denote magnetic fluxes Bd generated by the display device 134, and the arrow marks 154 to 156 indicate magnetic fluxes Bk generated by eddy current generated by the keyboard 135. The thus generated magnetic fluxes weaken the composite magnetic fluxes and decrease the electromotive force to be generated in the coil 131.

Accordingly, the decrease of the electromotive force by eddy current can be suppressed by decreasing the conductivity within a range within which the functions of the display device 134 and the keyboard 135 are not impaired thereby to suppress generation of the magnetic fluxes Bk and Bd to be generated by eddy current in the display device 134 and the keyboard 135.

Therefore, the conductivity of the display device 134 and the keyboard 135 is determined such that a condition given by the expression (4) below may be satisfied, that is, the induction electromotive force e(t) generated in the coil 131 may be higher than lowest electromotive force E necessary for the processing apparatus 102 to operate:

$$E < e(t) \quad (4)$$

The conductivity of the display device 134 and the keyboard 135 can be controlled, for example, by the material, size, shape and so forth of the display device 134 and the keyboard 135. In particular, the material, size, shape and so forth of the display device 134 and the keyboard 135 are determined so that the conductivity of the display device 134 and the keyboard 135 may satisfy the condition of the expression (4). In other words, such functional devices as the display device 134 and the keyboard 135 are made of a conductive substance having a conductivity with which eddy current is suppressed such that the electromotive force obtained at the coil 131 by a magnetic field which is generated from eddy current generated in the conductive substance is higher than the lowest electromotive force with which the functional devices can operate regardless of a magnetic field supplied from the outside for supplying power and acting in the opposite direction to that of the magnetic field for supplying power.

For example, the conductivity of the display device 134 and the keyboard 135 is controlled through selection of the material for the display device 134 and the keyboard 135 with regard to the conductivity such that the electromotive force of the coil 131 may be higher than the lowest electromotive force for operation of such functional devices as the regulator 132, control substance 133, display device 134 and keyboard 135. More particularly, where a synthetic substance of a plurality of materials having different conductivities from each other like an alloy of aluminum and copper which have different conductivities from each other is used as a material for the display device 134 or the keyboard 135, the mixture ratio of the materials (for example, aluminum and copper) is adjusted to control the conductivity of the display device 134 or the keyboard 135 so that the electromotive force of the coil 131 may be equal to or higher than the lowest electromotive force for operation of the regulator 132, control circuit 133, display device 134, keyboard 135 and so forth.

Figure 7:
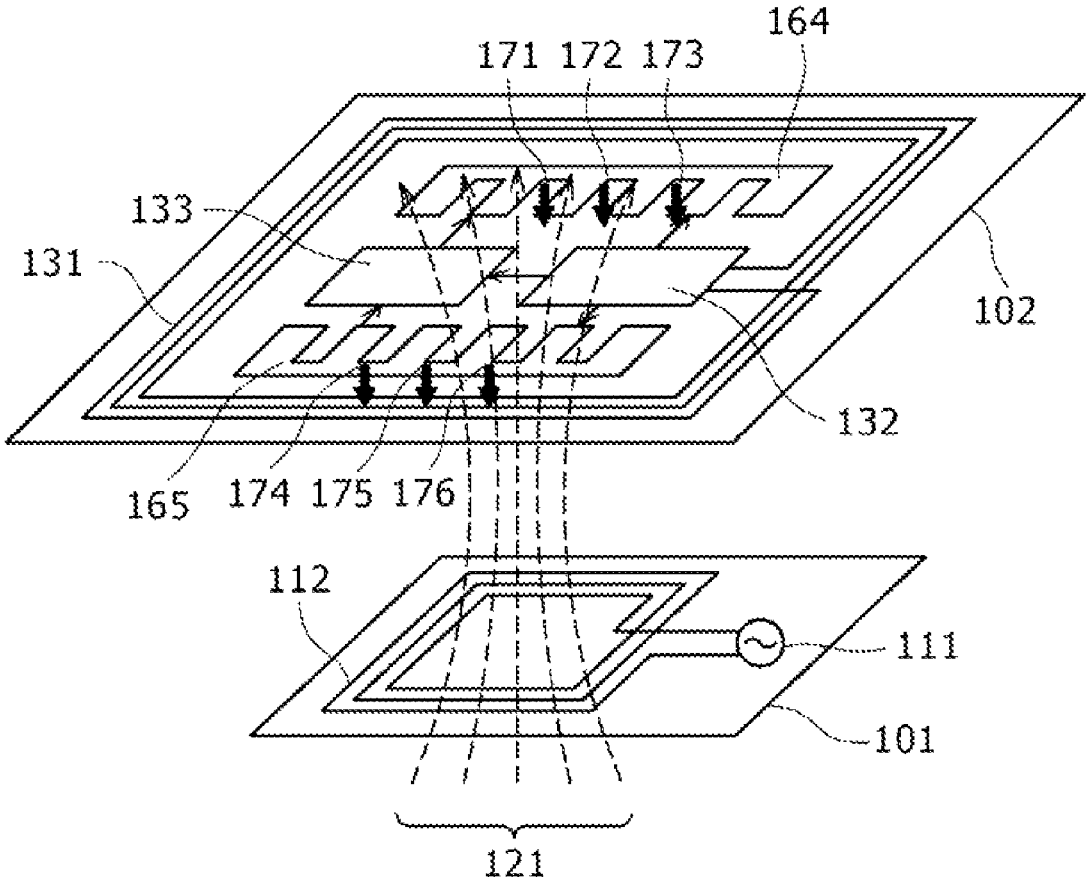
FIG. 7 is a schematic view showing an example of a configuration of a functional device.

Also it is possible to control the conductivity of a display device or a keyboard, for example, depending upon the shape of the display device or the keyboard as seen in FIG. 7. A display device 164 and a keyboard 165 shown in the arrangement of FIG. 7 have electrodes which are not distributed uniformly but have cut portions formed therein within a range within which they do not have an influence on the functions of the display device 164 and the keyboard 165. Since the shape described cuts the path of eddy current generated in the display device 164 and the keyboard 165, generation of eddy current can be further suppressed than that in an alternative case wherein the electrodes are distributed uniformly. Consequently, generation of magnetic fluxes in the opposite direction to that of magnetic fluxes of the linkage magnetic field 121 as indicated by arrow marks 171 to 176 in FIG. 7 is suppressed. As a result, reduction of the electromotive force in the coil 131 is suppressed so that the electromotive force may be equal to or hither than the lowest electromotive force for operation of such functional devices as the regulator 132, control circuit 133, display device 134 and keyboard 135.

Naturally, the number, size and so forth of the cuts of the display device and the keyboard can be set arbitrarily. Further, generation of eddy current may be suppressed by some other shape than cuts.

Since the material, size, shape or the like of functional devices which use a conductive material such as a display device and a keyboard is set so as to suppress the magnitude of eddy current to be generated in the functional devices as described above, the processing apparatus can readily suppress a drop of efficiency in power transmission from a power supplying apparatus without requiring specific configuration such as a magnetic. More particularly since the material, size, shape or the like of functional devices which use a conductive material such as the regulator 132, control circuit 133, display device 134, keyboard 135 and so forth is set so that the electromotive force of the coil may be equal to or higher than the lowest electromotive force for operation of the functional devices, the processing apparatus can readily implement suppression of a drop of the efficiency in power transmission from the power supplying apparatus. Consequently, since the number of parts unnecessary for an original function of the circuit such as, for example, a radio wave absorbent can be suppressed, the processing apparatus can achieve also reduction of the fabrication cost.

It is to be noted that the functional devices may be any other than the display device and the keyboard mentioned hereinabove and may be, for example, solar cells, operation buttons, various sensors and so forth. Particularly in recent years, for electronic paper, a dye-sensitized solar cell and so forth which get attention, the conductive material 141 which passes light therethrough is utilized frequently. It is to be noted that actually most of such substances frequently have little magnetic influence (are magnetically transparent).

Further, in the present specification, the term "system" is used to represent an entire apparatus composed of a plurality of devices (apparatus).

It is to be noted that any element which is described hereinabove as a single apparatus may otherwise be formed from a plurality of apparatus. Or conversely, a plurality of elements which are described hereinabove as separate apparatus from each other may be collectively formed as a single apparatus. Further, some other element than those described hereinabove may be included in the apparatus described above. Furthermore, some other element of a certain apparatus may be included in an element of another apparatus if the configuration and operation of the entire system are substantially same. In short, while preferred embodiments of the present invention have been described using specific terms, such description is for illustrative purpose only, and it is to be understood that changes and variations may be made without departing from the spirit or scope of the following claims.

What is claimed is:

1. An electromagnetic induction type processing apparatus, comprising:

a coil configured to generate an electromotive force from a magnetic field supplied from an outside; and a functional device configured to operate with the electromotive force and containing conductive substance having a conductivity with which an eddy current to be generated in the conductive substance by the magnetic field supplied from the outside is suppressed such that the lowest electromotive force for operation of said functional device is assured regardless of a magnetic field generated by the eddy current and acting in an opposite direction to that of the magnetic field supplied from the outside, wherein said functional device includes non-uniformly distributed electrodes electrically connected thereto, the non-uniformly distributed electrodes having a notch configured to suppress the eddy current generated in the non-uniformly distributed electrodes, and wherein said notch is arranged within the non-uniformly distributed electrodes so that the notch does not affect an ability of the functional device to perform a desired function.

2. The electromagnetic induction type processing apparatus according to claim 1, wherein said notch is configured to cut a path of the eddy current, thereby interrupting a flow of the eddy current and suppressing the eddy current.

3. The electromagnetic induction type processing apparatus according to claim 1, wherein said functional device is a dye-sensitized solar cell which contains the conductive substance.

4. The electromagnetic induction type processing apparatus according to claim 1, wherein said functional device is an operation button which contains the conductive substance.

5. The electromagnetic induction type processing apparatus according to claim 1, wherein said functional device is a sensor which contains the conductive substance.

* * * * *